US007066776B2

(12) United States Patent
Prakken

(10) Patent No.: US 7,066,776 B2
(45) Date of Patent: Jun. 27, 2006

(54) VESSEL PROVIDED WITH A PROPELLER TUNNEL

(75) Inventor: Bouwe Prakken, Kamerik (NL)

(73) Assignee: Blueprint Marine B.V., Woerden (NL)

( * ) Notice: Subject to any disclaimer, the term of this patent is extended or adjusted under 35 U.S.C. 154(b) by 138 days.

(21) Appl. No.: 10/684,549

(22) Filed: Oct. 15, 2003

(65) Prior Publication Data

US 2004/0192125 A1 Sep. 30, 2004

(30) Foreign Application Priority Data

Oct. 15, 2002 (NL) ..... 1021654

(51) Int. Cl.
*B63B 43/10* (2006.01)

(52) U.S. Cl. ..... 440/69; 114/48

(58) Field of Classification Search ..... 440/68, 440/69; 114/148, 288
See application file for complete search history.

(56) References Cited

U.S. PATENT DOCUMENTS 3,744,446 A * 7/1973 Gibbins ..... 440/69
3,848,561 A * 11/1974 Price ..... 440/69
4,300,889 A * 11/1981 Wormser ..... 440/69
4,685,889 A * 8/1987 Nystrom ..... 440/69

* cited by examiner

*Primary Examiner*—Jesus D. Sotelo
(74) *Attorney, Agent, or Firm*—Young & Thompson

(57) ABSTRACT

Vessel provided with a propeller protruding beyond the hull fitted in a propeller tunnel that extends as far as the stern of the vehicle. The surface area of the propeller tunnel recessed in the hull in a direction perpendicular to the longitudinal axis of the vessel is essentially constant over the length of the cavity. The width of the cavity increases in the upstream direction to the end of the tunnel.

2 Claims, 3 Drawing Sheets

VESSEL PROVIDED WITH A PROPELLER TUNNEL

BACKGROUND OF THE INVENTION

The present invention relates to a vessel having a motor-driven propeller extending beyond the hull thereof, as well as a cavity in said hull guiding the water flow to and from said propeller. More particularly, the invention relates to a ship that displaces water. Such a vessel is generally known. In order to restrict the draught of vessels, propeller tunnels are used so that, for a relatively large diameter, the propeller extends a relatively small distance below the rest of the hull. On the other hand, the ship and in particular the stem, must have adequate buoyancy.

GB 562 451 describes a vessel where the part of the hull downstream of the propeller is essentially constant. As a result a directional propulsive force can be developed and turbulence is restricted. This is particularly important because turbulence must as far as possible be prevented from coming into contact with the rudder. Moreover, the slip, that is to say the water flowing away laterally, must be controlled as far as possible.

However, the flow is disrupted by such a propeller tunnel, which means the efficiency is lowered. As a result the top speed decreases or the engine power has to be increased and/or the fuel consumption rises.

The aim of the present invention is to avoid this disadvantage and to provide a vessel with propeller tunnel without these disadvantages.

SUMMARY OF THE INVENTION

This aim is realised with a vessel having a motor-driven propeller extending beyond the hull thereof, as well as a cavity in said hull guiding the water flow to and from said propeller, wherein the surface area of said cavity is substantially constant in a direction perpendicular to the longitudinal axis over the length of said cavity upstream of said propeller.

It is thought that the improvement according to the invention is obtained in that the dynamic boundary layer that arises at the interface between the hull of the vessel and the water is as far as possible guided into the cavity upstream of the propeller.

This dynamic boundary layer arises at the interface between the hull of the vessel and the water. Part of this dynamic boundary layer has the speed of the vessel and energy is required in order to obtain this acceleration. According to the present invention provision is made that this dynamically accelerated water is as far as possible concentrated at the propeller, as a result of which an improvement in efficiency can be obtained. It must be understood that the validity of the patent is not dependent on the above assumption.

According to an advantageous embodiment of the invention, the cross-sectional surface area of the cavity is determined by drawing a line between the opposing hull/cavity transition points. This line is preferably a straight line.

It will be understood that in the upstream direction with respect to the propeller a transition ultimately takes place between tunnel and the flat section of the hull. After all, the propeller tunnel extends only over a limited portion of the vessel.

Variation in the cross-section can be obtained by varying the height/width ratio of the cavity.

According to the invention the height is a maximum and the width a minimum close to the propeller. At the propeller, the cavity generally has a circular shape, the curvature of which is greater than that of the propeller. In the direction upstream of the propeller the width of the cavity increases ever further as the distance from the propeller increases. The height correspondingly decreases further away, for a constant surface area.

In theory, the tunnel is infinitely wide with zero height at the location of the water inlet. On practical grounds, the tunnel has a length matched to the design of the ship.

The present invention can be applied both for vessels with a single propeller and for vessels with various propellers.

During tests it has been found that with the propeller tunnel described above a distinct improvement in efficiency is obtained as a result of a reduction in the slip of the propeller.

BRIEF DESCRIPTION OF THE DRAWINGS

The invention will be explained in more detail below with reference to an illustrative embodiment shown in the drawing. In the drawing.

DETAILED DESCRIPTION OF THE PREFERRED EMBODIMENTS

Figure 1:
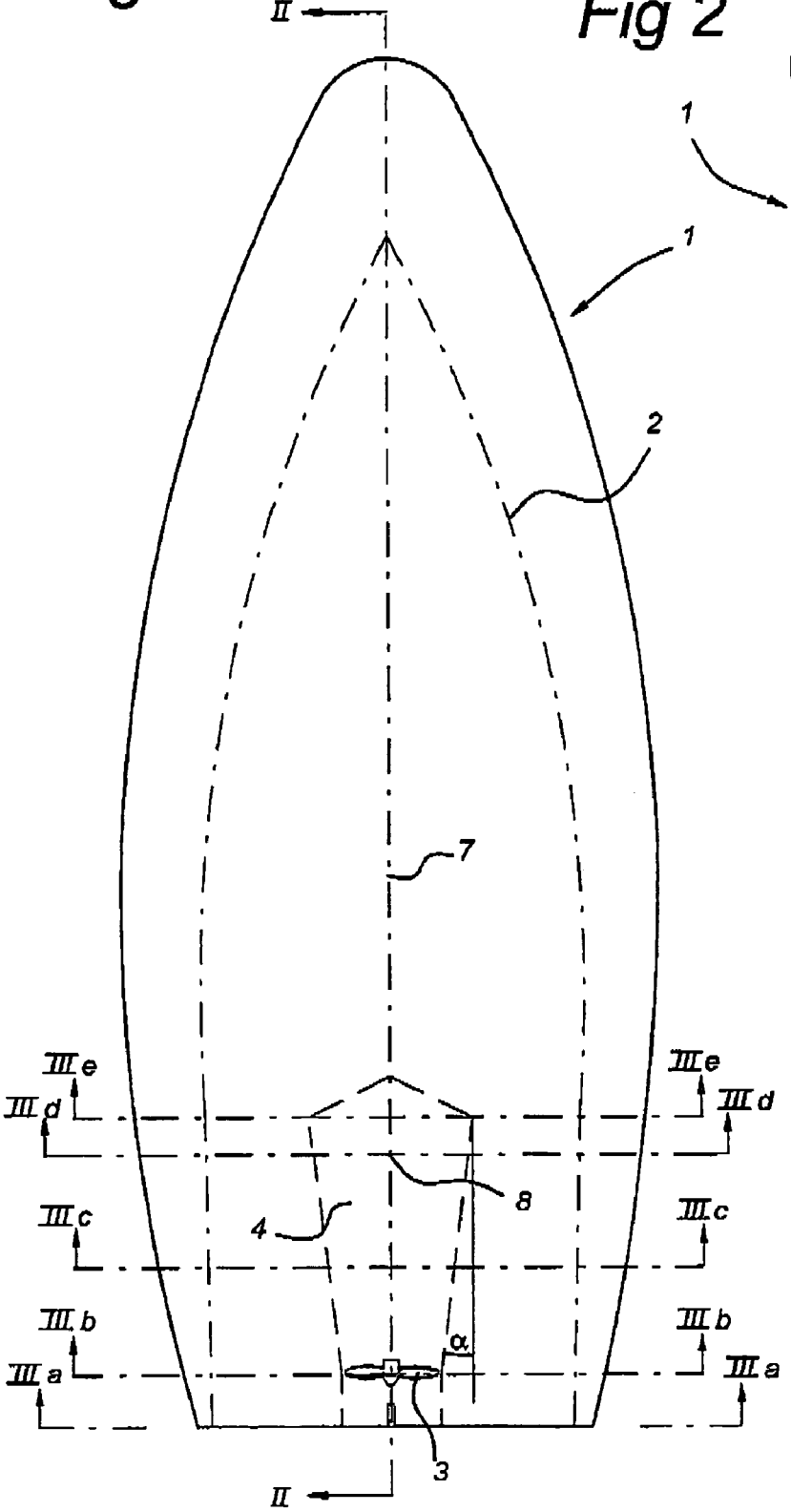
FIG. 1 shows, diagrammatically in plan view, a vessel with a single propeller according to the invention.

In FIG. 1 a vessel is indicated in plan view by 1. This vessel is shown in side view in section in FIG. 2. The waterline is indicated by 2. A propeller tunnel is indicated by 4. The boundary line between propeller tunnel 4 and the rest of the hull is indicated by 8. A propeller is indicated by 3, whilst 7 shows the longitudinal axis.

Figure 2:
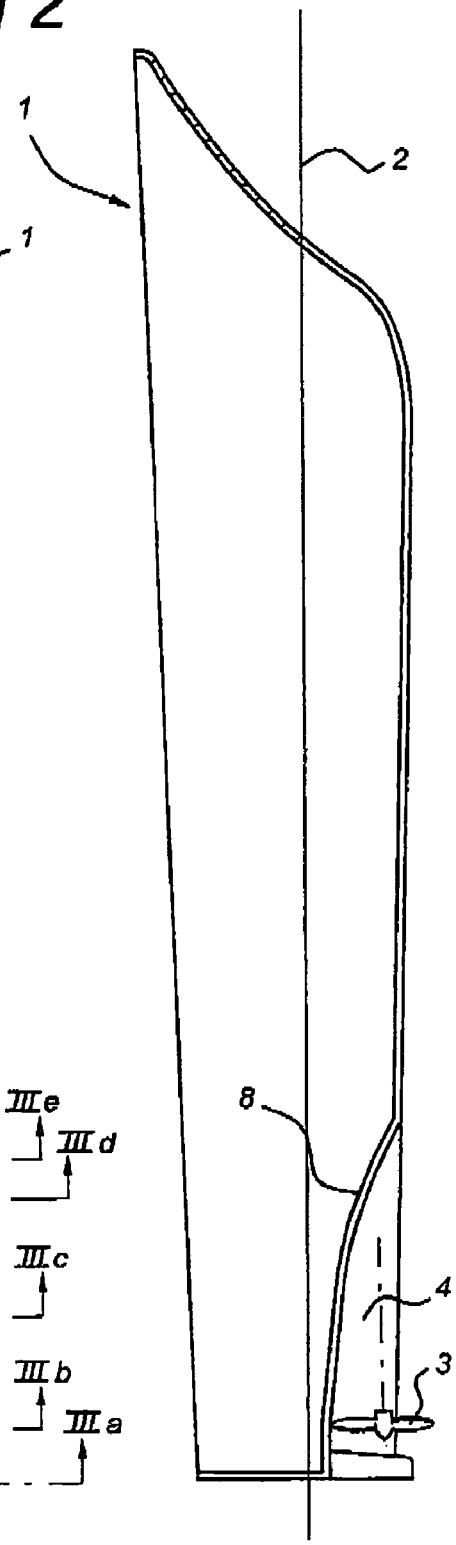
FIG. 2 shows the vessel according to FIG. 1 in side view in longitudinal section.

Various cross-sections of the vessel shown in FIGS. 1 and 2 are shown in FIGS. 3*a–e*. The transition point between the hull and the cavity or propeller tunnel 4 is indicated by 5. The surface area of A is determined by drawing a line between the opposing points 5 and the surface area lying within (above) this that is delimited by the cavity in the hull.

Figure 3A:
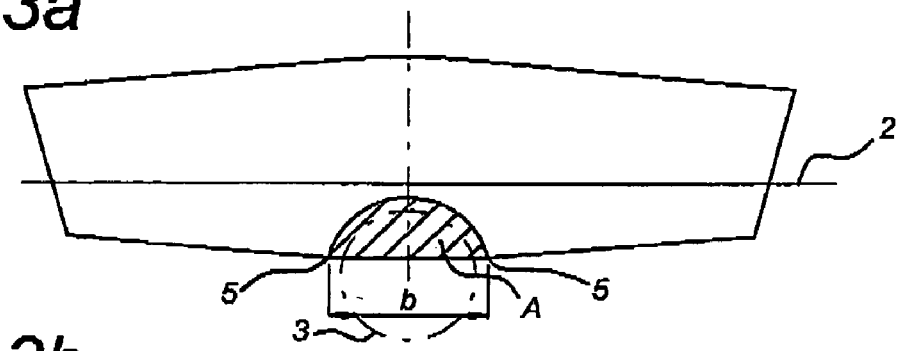
FIGS. 3*a–e* show various cross-sections as indicated in FIG. 1.
Figure 3B:
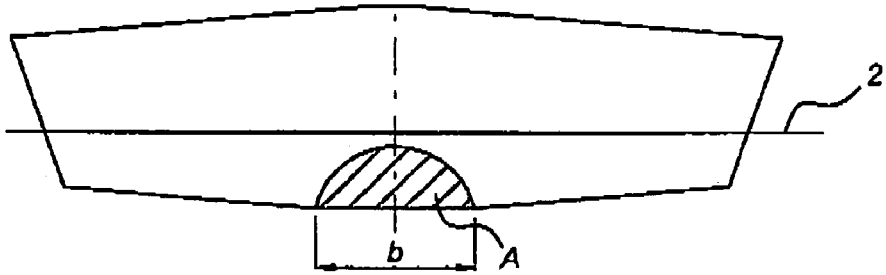
Figure 3C:
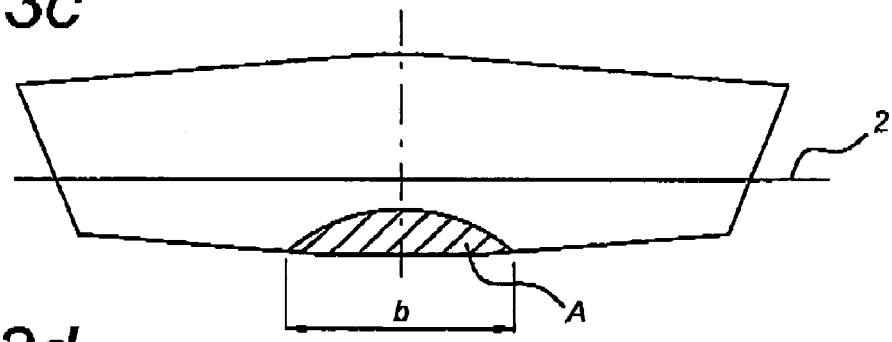
Figure 3D:
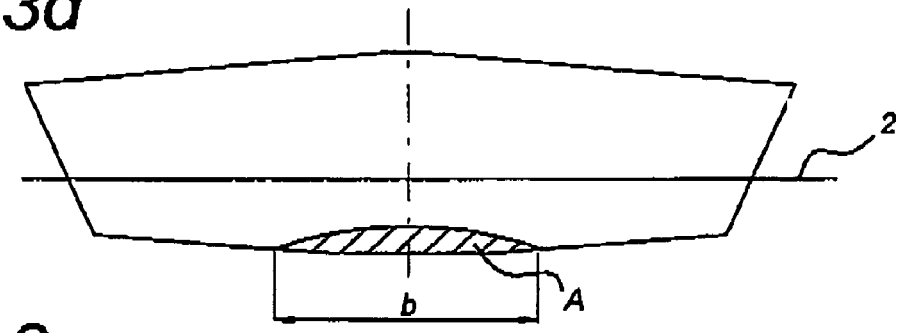
Figure 3E:
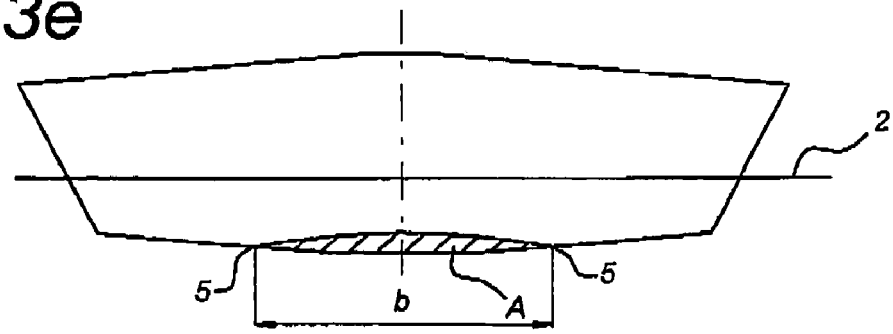

The surface area as shown in FIGS. 3*a–e* is essentially constant. As can be seen from the figures, the width b, that is to say the distance between the points 5, is not constant, which has consequences for the height. This width b is smallest at the location of the propeller 3, as is shown in FIG. 3*b*. Optimum guiding of the water between propeller and the cavity takes place at this location.

Figure 4:
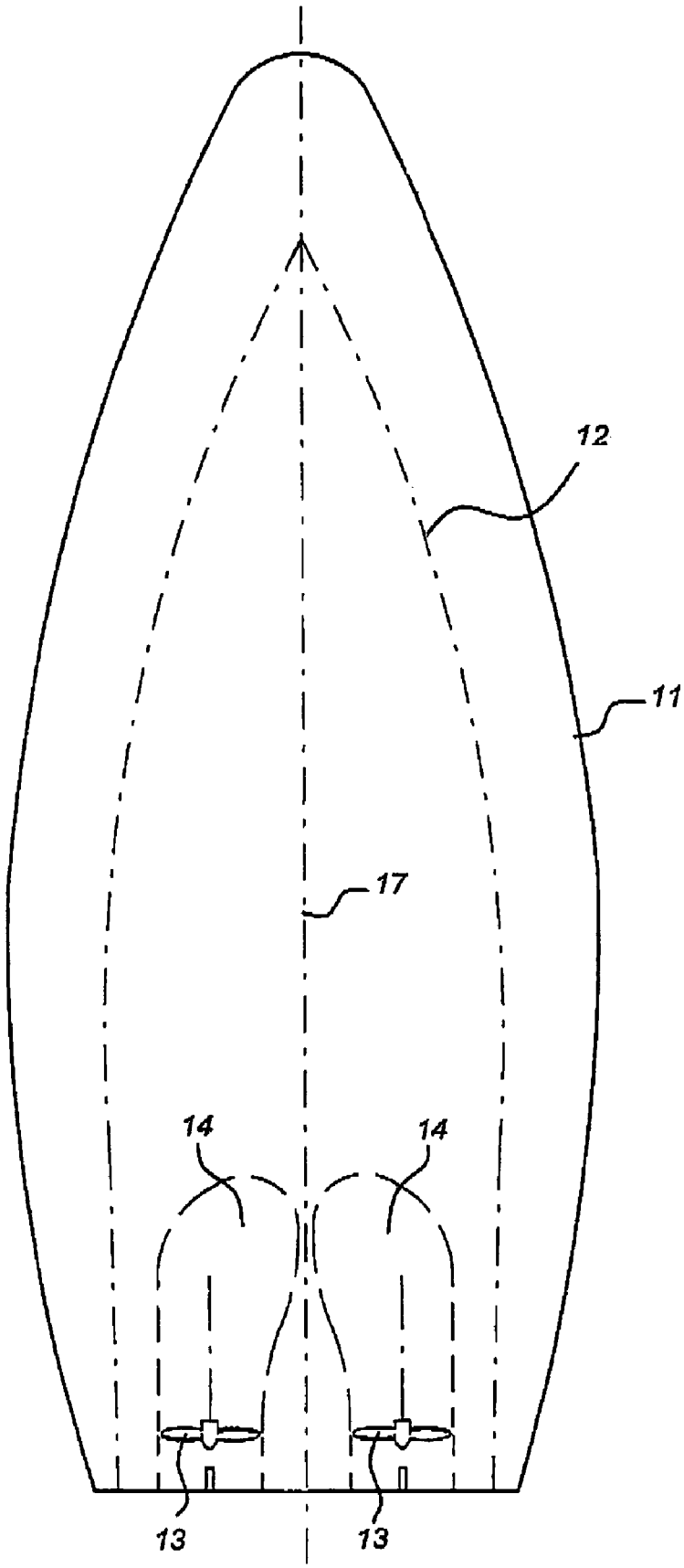
FIG. 4 shows a vessel according to the invention with twin propeller tunnel.

In FIG. 4 a possible variant is shown with which there are two propeller tunnels in the vessel indicated by 11. The waterline is indicated by 12, the propeller by 13 and the cavities or propeller tunnels by 14. The longitudinal axis of this vessel is indicated by 17. Although not shown in more detail, here as well the cross-sectional surface area, that is to say the surface area measured perpendicularly to the longitudinal axis 17, is substantially constant over the entire length of cavity 14 and the width of the propeller tunnel varies from a smallest width dimension close to the propeller 13 and becomes greater in the upstream direction.

According to the invention an appreciable improvement in the efficiency is obtained. It is assumed that a wake is produced that increases the effect of the propeller. It must be understood that the theoretical basis of the invention is not essential for the scope of protection of the present patent.

It will be understood that the determination of both the length of the tunnel, the width and the height thereof is dependent on the length of the vessel, the diameter of the propeller, the type of vessel and the desired sailing speed.

Although the invention has been described above with reference to illustrative embodiments to which preference is now given, it will be understood that numerous modifications can be made thereto which will be immediately apparent to those skilled in the art without going beyond the scope of the present application.

What is claimed is:

1. A vessel having a motor-driven propeller extending beyond the hull thereof, as well as a cavity in said hull guiding the water flow to and from said propeller, wherein an area defined by a cross-section of said cavity is substantially constant in a direction perpendicular to the longitudinal axis over the length of said cavity upstream of said propeller, wherein the width of said cavity increases upstream from said propeller.

2. The vessel as claimed in claim 1, wherein the boundary of the cross-sectional area of said cavity comprises a line drawn between opposing vessel hull/cavity transition points.

* * * * *